US011565860B2

(12) United States Patent
Presche

(10) Patent No.: US 11,565,860 B2
(45) Date of Patent: Jan. 31, 2023

(54) CLOSURE DEVICE FOR A CONTAINER

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 16/978,838

(22) PCT Filed: Mar. 8, 2019

(86) PCT No.: PCT/EP2019/055796
§ 371 (c)(1),
(2) Date: Oct. 2, 2020

(87) PCT Pub. No.: WO2019/170841
PCT Pub. Date: Sep. 12, 2019

(65) Prior Publication Data

US 2021/0061530 A1 Mar. 4, 2021

(30) Foreign Application Priority Data

Mar. 8, 2018 (DE) ..... 10 2018 105 326

(51) Int. Cl.
*B65D 51/28* (2006.01)

(52) U.S. Cl.
CPC ..... *B65D 51/2878* (2013.01)

(58) Field of Classification Search
CPC .. B65D 51/2878; B65D 1/0238; B65D 51/18; B65D 51/28; B65D 51/24
USPC ..... 206/219, 221, 222; 215/227; 220/254.3, 220/254.1, 257.1, 256.1
See application file for complete search history.

(56) References Cited

U.S. PATENT DOCUMENTS

2008/0142030 A1* 6/2008 Venere ..... A45D 19/012 222/129
2009/0236244 A1 9/2009 Frutin
2017/0107030 A1 4/2017 Presche
2020/0247597 A1 8/2020 Maguire et al.

FOREIGN PATENT DOCUMENTS

DE 102014113391 A1 11/2015
KR 20110137003 A 12/2011
WO 2007/129116 A1 11/2007
WO 2017/207962 A1 12/2017

OTHER PUBLICATIONS

International Search Report of PCT/EP2019/055796, dated Jul. 3, 2019.

* cited by examiner

*Primary Examiner* — Rafael A Ortiz
*Assistant Examiner* — Sanjidul Islam
(74) *Attorney, Agent, or Firm* — Collard & Roe, P.C.

(57) ABSTRACT

A closure device for closing a container opening of a container, in particular a beverage bottle, has a cover element, a chamber arranged on the cover element and an inner housing. The chamber and the inner housing have closing and opening devices which correspond to one another and interact with one another in such a way that a medium contained in the chamber can move into the container as a result of a movement of the cover element relative to the inner housing. In order to further improve the closure device in particular with regard to a favorable producibility, the chamber, which is designed to be closed except for an opening on the container side, is retained in the cover element in a latching manner.

8 Claims, 10 Drawing Sheets

CLOSURE DEVICE FOR A CONTAINER

CROSS REFERENCE TO RELATED APPLICATIONS

This application is the National Stage of PCT/EP2019/055796 filed on Mar. 8, 2019, which claims priority under 35 U.S.C. § 119 of German Application No. 10 2018 105 326.6 filed on Mar. 8, 2018, the disclosure of which is incorporated by reference. The international application under PCT article 21(2) was not published in English.

TECHNICAL FIELD

The invention pertains to a closure device for closing a container opening of a container, particularly a beverage bottle, wherein the closure device has a cover element, a chamber arranged on the cover element and an inner housing, wherein the chamber and the inner housing have closing means and opening means, which correspond to one another and interact with one another in such a way that a medium contained in the chamber can exit into the container as a result of a movement of the cover element relative to the inner housing, and wherein the chamber, which is designed to be closed except for an opening on the container side, is retained in the cover element in a latching manner.

PRIOR ART

Closure devices of the type in question are known. They serve, e.g., for closing a container and for simultaneously providing a chamber for the separate storage of liquid or powdery mediums, for example tea essences or the like, such that these mediums do not immediately come in contact with and/or are mixed with the contents of the container, for example water, when the container is filled, but only at the moment, at which the closure device is removed from the container. This is typically the moment, at which the contents of the container should be consumed.

For example, publication WO 2007/129116 A1 pertains to such a closure device, which upon opening a container closed with this closure device releases a supplemental liquid located in the chamber into the container. The closure device has a cover element, a chamber and an inner housing. The inner housing has a discharge opening, into which a plug element connected to the inner housing engages in a sealing manner. The cover element and the inner housing are connected to one another by means of screw threads, wherein the cover element can be raised relative to the inner housing from a closed position, in which the plug element closes the discharge opening of the chamber, into a discharge position, in which the plug element is at least partially retracted from the discharge opening, in order to thereby produce a passage from the chamber into the main liquid space of the container. In this way, the medium stored in the chamber can exit into the container, where it is mixed with the medium located in the container.

WO 2017/207962 A1 discloses a closure device with a latching retention of the chamber in the cover element. For this purpose, an end of the chamber wall associated with the ceiling of the cover element is formed by an extent of the chamber wall itself in the sense of a constriction and a gripping formation that protrudes downward from the cover element is realized.

SUMMARY OF THE INVENTION

Based on the aforementioned prior art, the invention aims to additionally enhance the closure device, particularly with respect to a favorable producibility and an advantageous usability.

This objective is attained by a closure device according to the invention, according to which it is proposed that a shoulder or a circumferential latching bead is formed on the outer side of the chamber wall in order to interact with the cover element in a latching manner. The chamber can thereby be favorably retained in the cover element without influencing the chamber wall itself.

The chamber can be produced separately of the cover element and subsequently retained on or in the cover element in a latching manner. This also provides advantages regarding the production technology, for example with respect to the chosen materials of the chamber and/or the cover element and/or with respect to the respective production method.

The chamber alone, i.e. without inclusion of the cover element, preferably can be altogether designed in a closed manner—with the exception of the opening on the container side. Accordingly, it is not required to form a seal between the chamber and the cover element—if applicable with the exception of the region of the opening on the container side.

Due to the separate design of the chamber and the latching retention thereof on the cover element, a chamber that is adapted with respect to the volumetric capacity and/or with respect to the medium to be received in the chamber can also be retained in the cover element.

The latching retention of the chamber in the cover element preferably can be designed such that it cannot be operationally disengaged. The latching retention cannot be disengaged at least until the chamber contents have been completely emptied into the container.

The chamber may have a region with a smaller diameter and a region with a larger diameter, wherein the region with the larger diameter is spaced apart farther from the opening and the region with the larger diameter including a ceiling is formed integrally with the region with the smaller diameter. For example, the maximum extent of the region with the larger diameter transverse to a longitudinal axis of the chamber may correspond to between 1.2-times and 3-times, e.g. 2-times, the maximum extent of the region with the smaller diameter in the same direction.

The region with the smaller diameter faces the opening and in a potential embodiment forms this opening directly.

The transition area from the region with the larger diameter into the region with the smaller diameter may with respect to a longitudinal section through the chamber extend in a funnel-shaped manner in the direction of the region with the smaller diameter.

The integral design of the chamber including the region with the smaller diameter, the region with the larger diameter and the ceiling may be realized, for example, by producing the tank in an injection blow moulding process. Polyethylene terephthalate (PET) is a particularly suitable material for this purpose. The cover element may be produced in a plastic injection moulding process, e.g. of polypropylene (PP) or polyethylene (PE).

The chamber may also be produced by utilizing a plastic injection stretch blow moulding process, in which the heated preform is additionally stretched in the longitudinal direction, e.g. by utilizing a stretching rod guided through the preform opening, prior to or simultaneously with the conventional injection blow moulding process (extrusion blow moulding) in order to produce hollow bodies of a thermoplastic. For example, an attainable blow-up rate (smallest opening diameter:largest outside diameter) may be as high as 1:10 in this case.

In a preferred embodiment, the shoulder formed on the outer side of the chamber wall serves for interacting with corresponding counterlatching means of the cover element in a latching manner.

In a potential embodiment, the shoulder may be formed on the outer side of the chamber wall in the region with the smaller diameter, wherein the shoulder is particularly realized integrally with the chamber and preferably made of the same material as the chamber.

A circumferential latching bead may also be formed on the outer side of the chamber wall in order to interact with the cover element in a latching manner. This results in a bead-like thickening of the corresponding chamber wall section with a preferred protruding dimension, which may approximately correspond to between 0.5-times and 2-times the material thickness of the chamber wall section in a wall region lying directly adjacent to the latching bead.

The cover element may have a latching collar for interacting with the shoulder or the latching bead on the chamber side. This latching collar forms a counterlatch, over which the shoulder or the latching bead is moved in the course of the assembly of the chamber and the cover element such that the shoulder or the latching bead is subsequently supported on the latching collar opposite to the inserting direction.

The chamber wall may furthermore have a supporting shoulder. A support of the chamber on the latching collar in the assembly direction can be achieved by means of this supporting shoulder, wherein the chamber is simultaneously fixed on the cover element in a latching manner at an axial distance from the support. For example, the latching collar may be captured in the axial direction between the latching bead and the supporting shoulder.

In a potential embodiment, the latching collar may be penetrated by the region of the chamber with the smaller diameter, wherein the clear cross-sectional area of the latching collar, through which the region with the smaller diameter extends, has a smaller diameter than the region of the chamber with the larger diameter. A potential latching bead therefore is preferably associated with the region of the chamber wall with the smaller diameter.

The latching connection may also be chosen in such a way that the region with the larger diameter, which essentially accommodates the medium, is in the latched and retained position supported on the inner wall side of the cover element over its entire surface or partially at least with respect to the ceiling and the circumferential wall about the longitudinal axis. This support does not necessarily have to be realized over the entire surface, i.e. over 100 percent of the total surface resulting from the circumferential wall surface and the ceiling surface. For example, a nearly full-surface contact on the facing inner wall side of the cover element may be realized circumferentially along the chamber wall in the region with the larger diameter whereas the ceiling of the chamber is spaced apart from the facing ceiling of the cover element, e.g., by means of web-like formations of the cover element. The chamber ceiling may therefore be supported on the cover element in the region of the rib-like projections.

It would alternatively also be possible that the chamber ceiling and/or the circumferential chamber wall is at least partially, but optionally also completely, not overlapped or encompassed by the cover element in the region with the larger diameter. Accordingly, the ceiling and/or wall regions of the chamber may be at least partially exposed outward and thereby form part of the visible outer surface of the closure device. The contents of the chamber may therefore be visible in a potential transparent or partially transparent design of the chamber ceiling and/or chamber wall.

The chamber preferably can be positively secured on the cover element, preferably about a longitudinal axis that penetrates the opening on the container side in an emptying direction of the chamber. In this way, the chamber is retained in the cover element in a rotationally secured manner such that a rotational movement of the cover element about the longitudinal axis is reliably transmitted to the chamber. This allows a displacement relative to the inner housing in order to thereby release the opening on the container side into a discharge position for outputting the medium stored in the chamber when the closure device is displaced.

The chamber may be positively secured by means of one or more flattenings, which are formed in an outer surface and extend in the longitudinal direction of the chamber over one-fifth or more of the dimension of the region with the larger diameter, wherein said flattening interacts with an identically shaped inner flattening of the cover element. The flattening of the chamber side may extend in the longitudinal direction as far as the entire dimension of the region with the larger diameter or, e.g., as far as two-thirds, three-quarters or eight-ninth of the dimension in the longitudinal direction.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
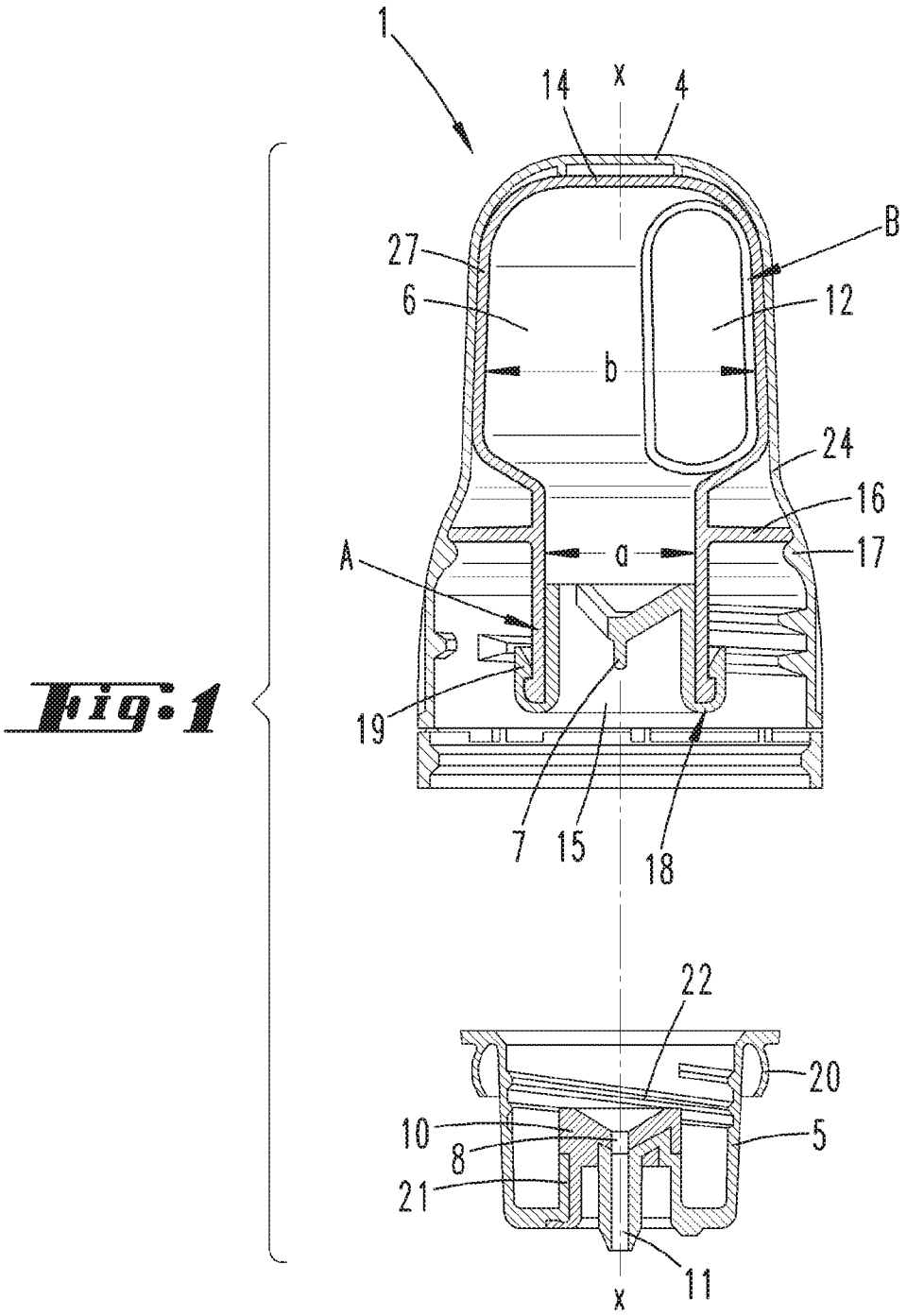
FIG. 1 shows a vertical section through a closure device concerning a first embodiment.

A closure device 1 with a chamber 6 having a lower opening is illustrated and described, wherein opening means, which make it possible to empty the chamber 6, are provided relative to said opening.

The opening means particularly consist of an opening part, which in the exemplary embodiment is specifically realized in the form of a sealing element 10. This opening part has two circumferential sealing zones. One sealing zone preferably is realized on an outer circumferential surface of the opening means, which furthermore interacts with an inner surface of the chamber 6. Another sealing zone is realized such that it is inwardly offset relative to the aforementioned sealing zone and interacts with a closure pin 7 in the exemplary embodiment.

The aforementioned sealing zones are arranged concentrically relative to the chamber 6 in a perpendicular direction—referred to an emptying direction E when the opening means is opened.

The illustrations in FIGS. 1 to 7 show a first embodiment of an upper partial region of a container 2, in this case a beverage bottle, on the container opening 3 of which a closure device 1 is arranged. This closure device 1 is positioned relative to the container 2 such that it seals the container opening 3 in a fluid-tight manner.

The closure device 1 is conventionally screwed on the container 2 such that the container opening 3 is sealed. In this state, the container 2 can be stored over a prolonged period of time without allowing the contents to escape from the container 2. In order to open the container 2, the closure device 1 is conventionally unscrewed from the container 2 such that the container opening 3 ultimately is completely exposed.

The closure device 1 has a cover element 4, a chamber 6 arranged on the cover element 4 and an inner housing 5. In the—non-restrictive—embodiment shown, the cover element 4 is a plastic lid, e.g. of polypropylene (PP) or polyethylene (PE).

The chamber 6 preferably can be produced in the form of a part that is realized separately of the cover element 4 and consists, e.g., of polyethylene terephthalate (PET). It is preferably produced in a plastic injection stretch blow moulding process, or alternatively in a plastic injection blow moulding process.

The chamber 6 is essentially composed of a region A with a smaller diameter and a region B with a larger diameter. These two regions A and B are arranged axially behind one another with respect to a longitudinal axis x, which in the associated position is oriented in the emptying direction E.

The region B with the larger diameter has a maximum extent b transverse to the longitudinal axis x, which approximately corresponds to between 1.5-times and 2-times, e.g. between 1.6-times and 1.8-times, the maximum extent a of the region A with the smaller diameter in the same direction. The extents a and b refer to the clear length transverse to the longitudinal axis x within the chamber 6, i.e. measured up to the inner wall side of the chamber 6.

The length of the regions A and B in the axial direction is approximately chosen identical, wherein the axial length of a partial region may according to the embodiment shown approximately correspond to the extent b.

Furthermore, the regions A and B are initially and essentially chosen circularly with respect to a cross section transverse to the longitudinal axis x. The region A with the smaller diameter, in particular, preferably does not deviate from this cross-sectional circular shape.

In contrast, the region B with the larger diameter has flattenings 12, which approximately lie diametrically opposite of one another, in the exemplary embodiment shown. With respect to the aforementioned cross section, these flattenings extend in an approximately secant-like manner to the otherwise circular circumference.

The flattenings extend over nearly the entire axial length of the region B with the larger diameter.

Inner flattenings 13 of essentially identical shape are formed corresponding to the flattenings 12 in the region of the cover element 4. The further cross-sectional shape of the cover element 4 in the section encompassing the chamber wall in the region B corresponds to the segmental extent of the chamber wall.

The regions A and B are realized integrally and made of the same material. The transition area from the region B with the larger diameter into the region A with the smaller diameter is realized in a funnel-shaped manner up to the region A with the smaller diameter.

The region B with the larger diameter forms a ceiling 14 on the side facing away from the region A with the smaller diameter. This ceiling is also realized integrally with the chamber wall and made of the same material as the chamber wall.

Accordingly, the chamber 6 is realized in a closed manner except for an opening 15 on the container side.

A circumferential shoulder 16 is integrally formed on the outer wall side of the region A with the smaller diameter. According to the exemplary embodiment shown, this shoulder may extend transverse to the longitudinal axis x in a disk-like manner.

The shoulder 16 serves for fixing the chamber 6 in the cover element 4 in a latching manner, wherein the shoulder 16 engages behind a counterlatch 17 formed on the inner wall side of the cover element 4 in the latched and fixed position according to the illustration in FIG. 1.

In this latched and fixed position, the chamber 6 essentially is captured in the axial direction between the counterlatch 17 of the cover element 4 and a ceiling section of the cover element 4. Furthermore, the chamber 6 is accommodated in the cover element 4 in a rotationally secured manner, namely as a result of the interaction between the flattenings 12 and the inner flattenings 13.

This rotational security may also be achieved with other geometric outline shapes of the chamber 6 and the cover element 4 in the interacting region as long as this outline shape deviates from a strict circular shape.

For example, only one flattening 12 and one corresponding inner flattening 13 may be provided, but it would also be possible to provide a plurality of respective flattenings.

A closure pin 7 is retained in a latching manner on the chamber 6, particularly on the region A with the smaller diameter that forms a discharge nozzle. A latching part 18 is used for this purpose. The latter is with respect to a longitudinal section essentially realized in a U-shaped manner with a circumferential latching collar 19 that encompasses the free end region of the discharge nozzle. In the latched and fixed position, this latching collar engages behind a correspondingly adapted radial step of the discharge nozzle along the opening edge.

The latching part 18 forms an inner circumferential wall that is supported on the inner wall side of the region A with the smaller diameter. The closure pin 7 is integrally formed on this wall, e.g. by means of a cruciform web arrangement.

The inner housing 5 has a pot-like design with a circumferential pot wall and a collar for being supported on the container edge surrounding the container opening 3.

A circumferential sealing lip 20 is integrally formed on the underside of the inner housing collar. In the associated position, this sealing lip interacts with the container wall surrounding the container opening 3.

The inner housing 5 forms a channel dome 21 on the side of the pot base. This channel dome centrally carries a pin-shaped formation with a flow channel 11 extending in the direction of the longitudinal axis x. This pin-shaped formation with the flow channel 11 may be connected to the channel dome 21 by means of a cruciform web-like connection, but this aspect is not illustrated in greater detail in the drawings.

In the exemplary embodiment shown, the material of a sealing element 10 is injection-moulded, in particular, around the above-described connecting region such that the sealing element 10 essentially extends facing the chamber 6, but also at least partially underneath the dome ceiling.

The sealing element 10 may on the side facing the chamber 6 be cross-sectionally tapered from radially outside toward the center in a funnel-shaped manner.

The outside diameter of the sealing element 10 corresponds to that of the channel dome 21 and is furthermore adapted to the clear inside diameter of the latching part 18 carrying the closure pin 7 such that a sealing effect between the sealing element 10 and the inner wall of the chamber 6 or the latching part 18 is achieved in the usage position.

The latching part 18 may furthermore also be retained on the chamber 6 by means of welding.

The inner housing 5 is connected to the chamber wall by means of a thread 22.

Figure 2:
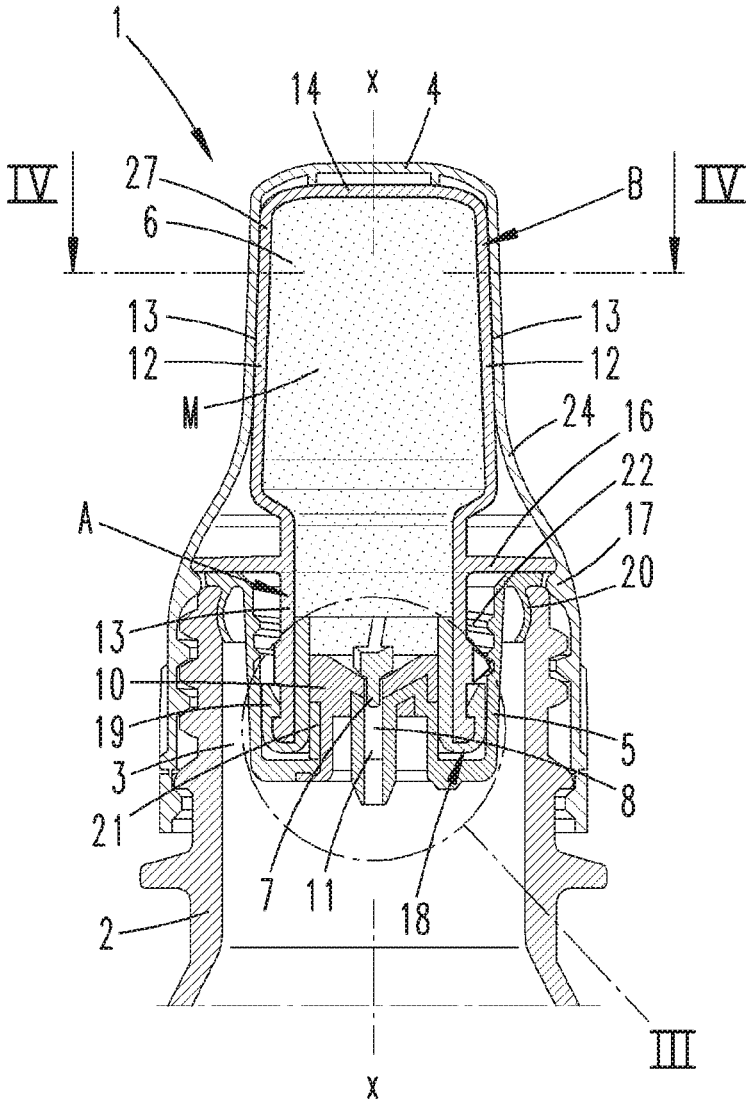
FIG. 2 shows the closure device according to FIG. 1 in its arrangement on a container concerning the closed position.
Figure 3:
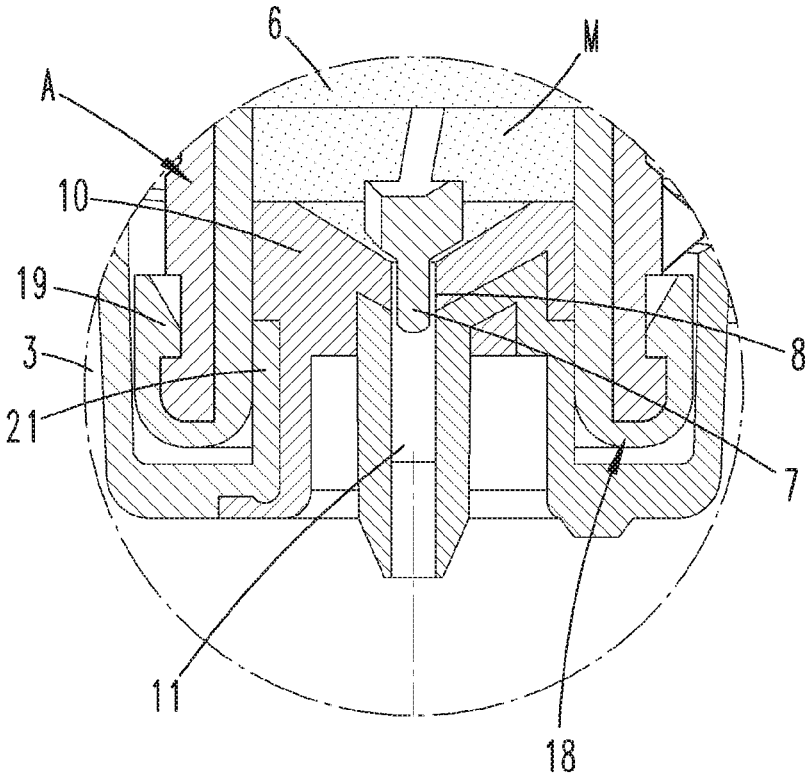
FIG. 3 shows an enlarged detail of the region III in FIG. 2.
Figure 4:
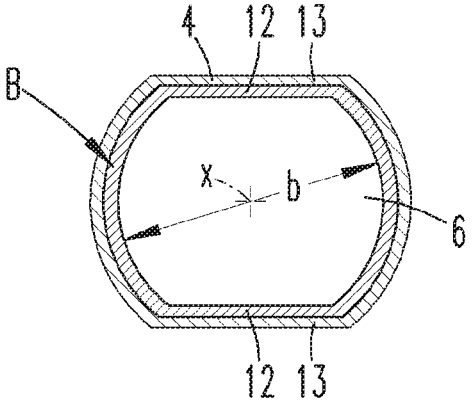
FIG. 4 shows a section along the line IV-IV in FIG. 2.
Figure 5:
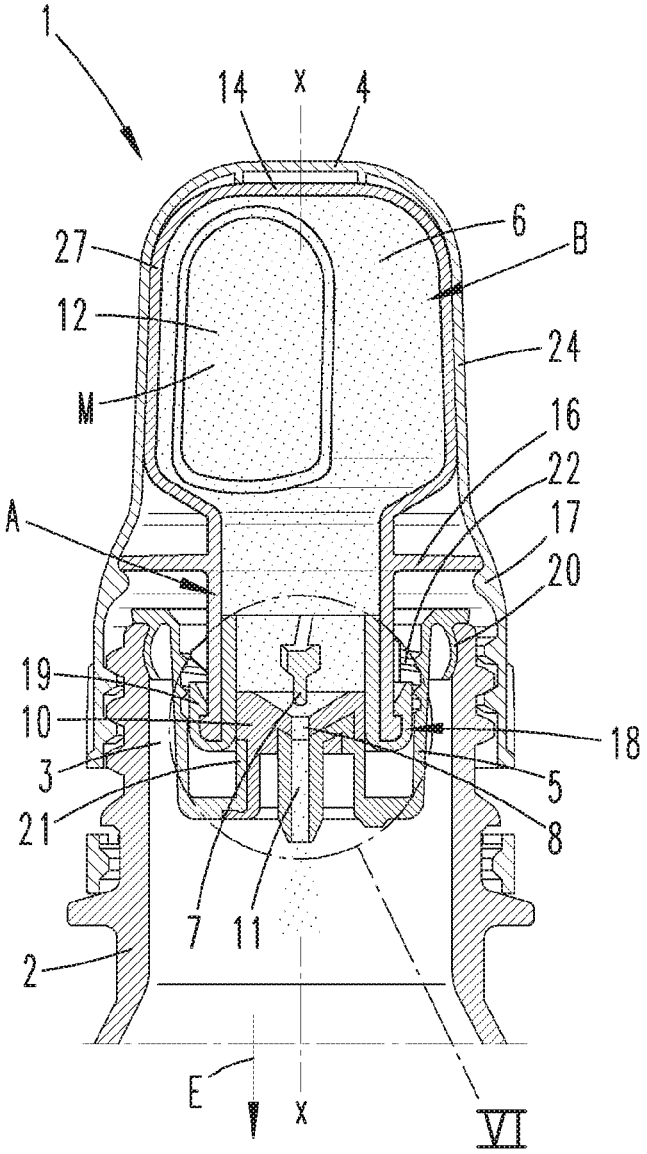
FIG. 5 shows a representation that essentially corresponds to FIG. 2, but concerns the discharge position.
Figure 6:
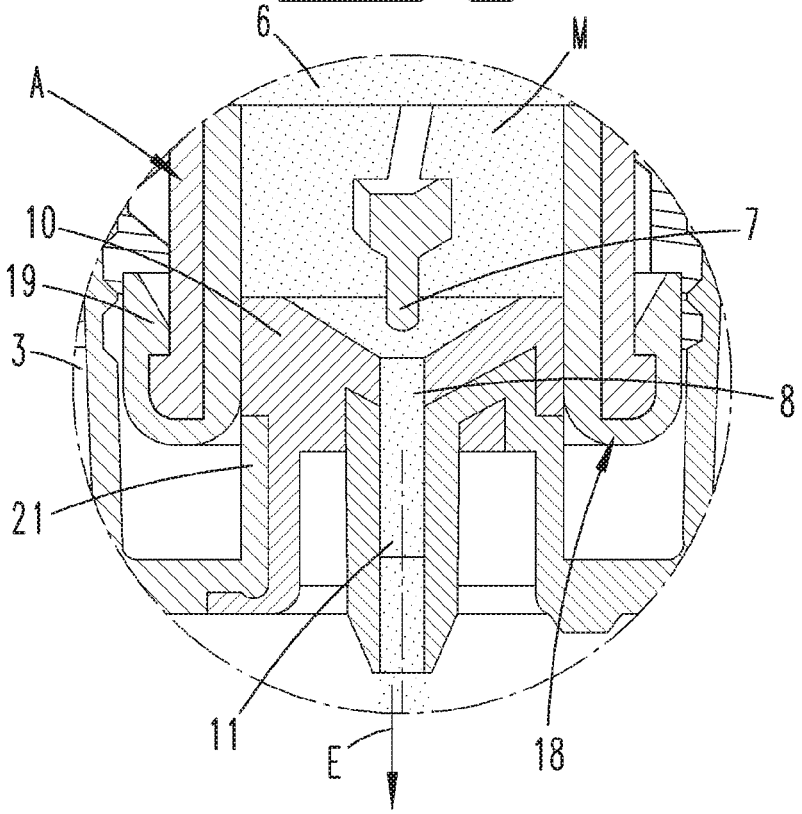
FIG. 6 shows an enlarged detail of the region VI in FIG. 5.
Figure 7:
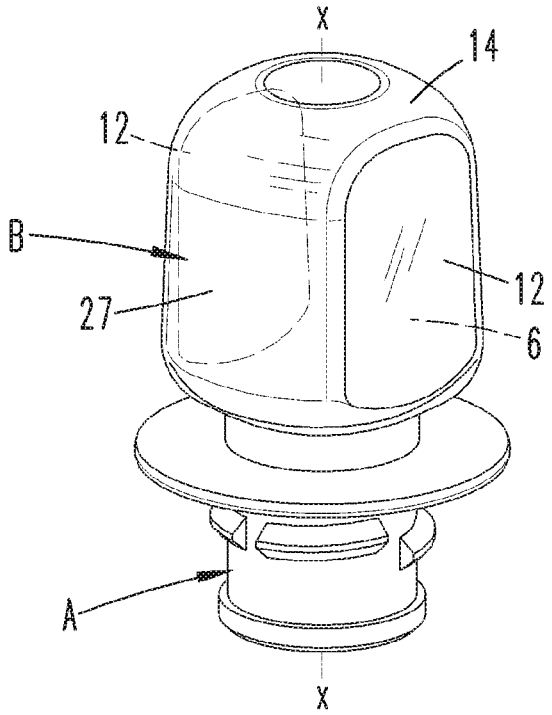
FIG. 7 shows the tank of the closure device in the form of a perspective individual representation.
Figure 8:
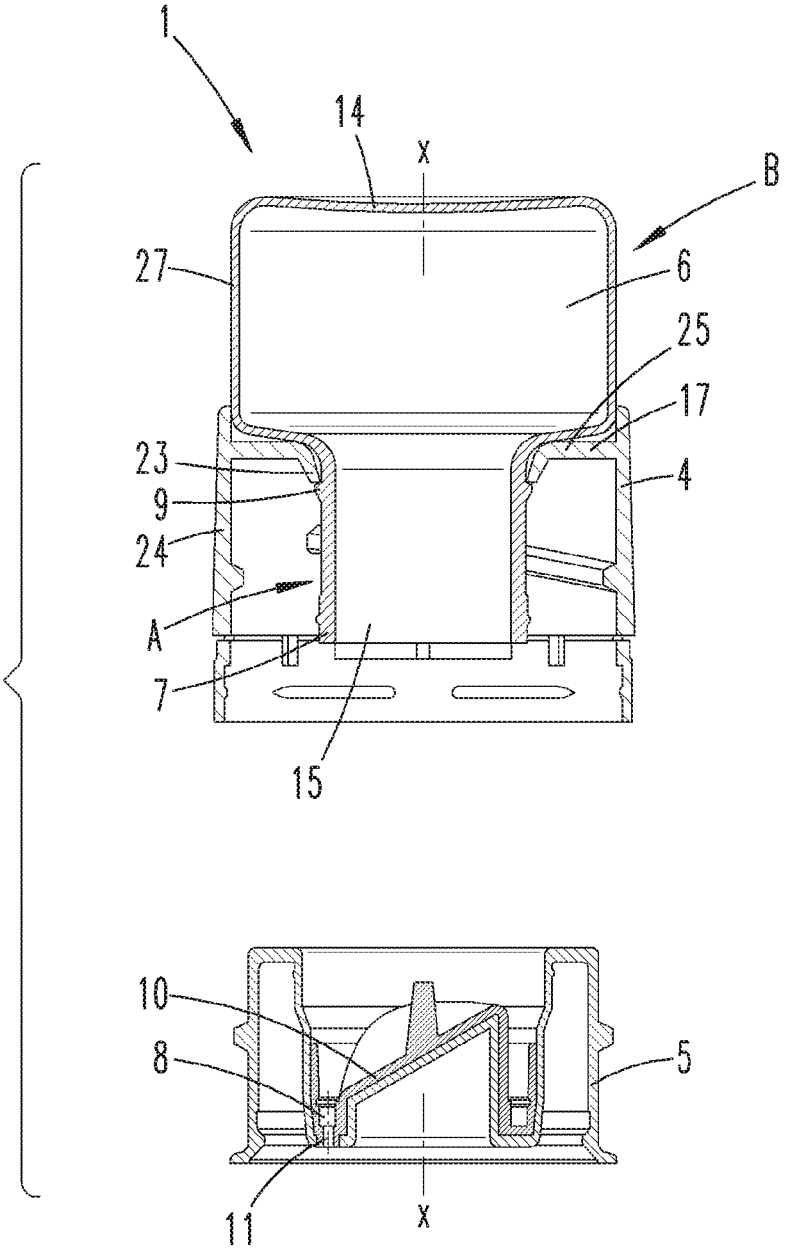
FIG. 8 shows a sectional representation according to FIG. 1 concerning a second embodiment.
Figure 9:
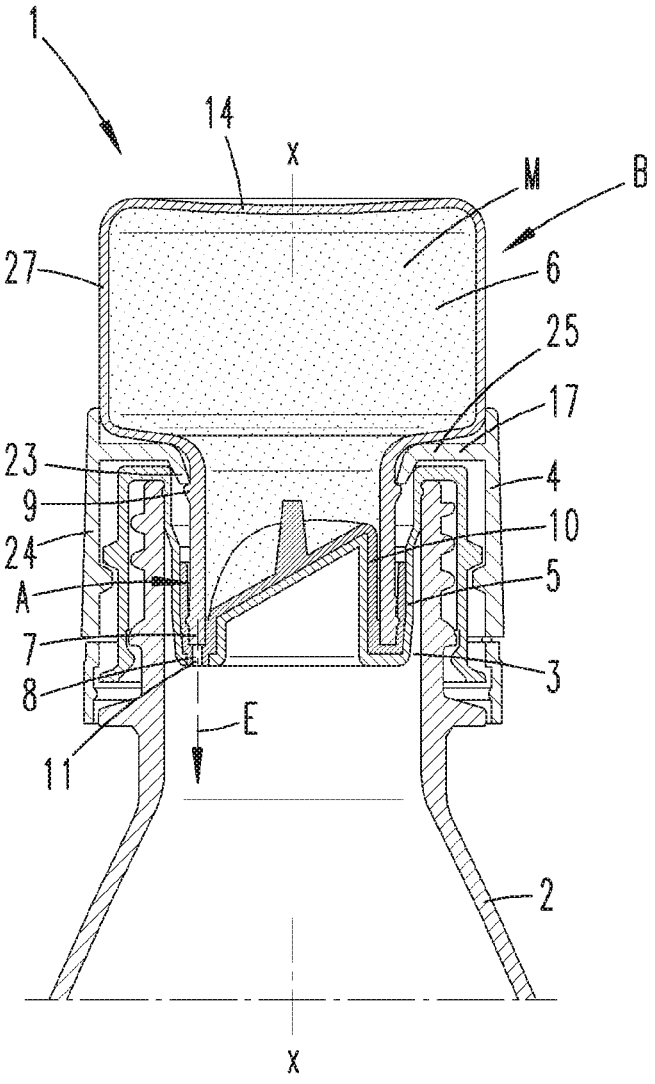
FIG. 9 shows a representation that essentially corresponds to FIG. 2, but concerns the embodiment according to FIG. 8.

In the closed position according to FIG. 2, the closure pin 7 penetrates into the closure opening 8 in order to close the chamber 6 in a sealing manner.

An axial displacement of the closure pin 7 relative to the inner housing 5 is achieved as a result of the cover element 4 and thereby the chamber 6, wherein the closure pin 7 releases the closure opening 8 in order to discharge the stored medium from the chamber 6 into the container interior.

The inner housing 5 (initially) is rotationally secured by means of a frictional engagement between the sealing lip 20 and the container wall.

FIGS. 8 to 12 show alternative embodiments, in which a latching bead 9 is formed circumferentially—with respect to the longitudinal axis x—on the outer wall side of the region A of the chamber 6 with the smaller diameter, wherein said latching bead serves for interacting with a latching collar 23 of the cover element 4 in a latching manner. The latching collar 23 accordingly forms the counterlatch 17.

The latching collar 23 preferably can be formed on a collar 25 that circumferentially extends transverse to the longitudinal axis x and starts on the inner side of the cover element wall 24, wherein said collar centrally leaves a through-opening for the region A of the chamber 6 with the smaller diameter. The collar 25 provides a supporting surface for the chamber 6 in the region of the transition from the region B with the larger diameter into the region A with the smaller diameter.

The circumferential edge of the through-opening, which directly interacts with the latching bead 9, is curved in the inserting direction—which in the exemplary embodiment corresponds to the emptying direction E.

Figure 10:
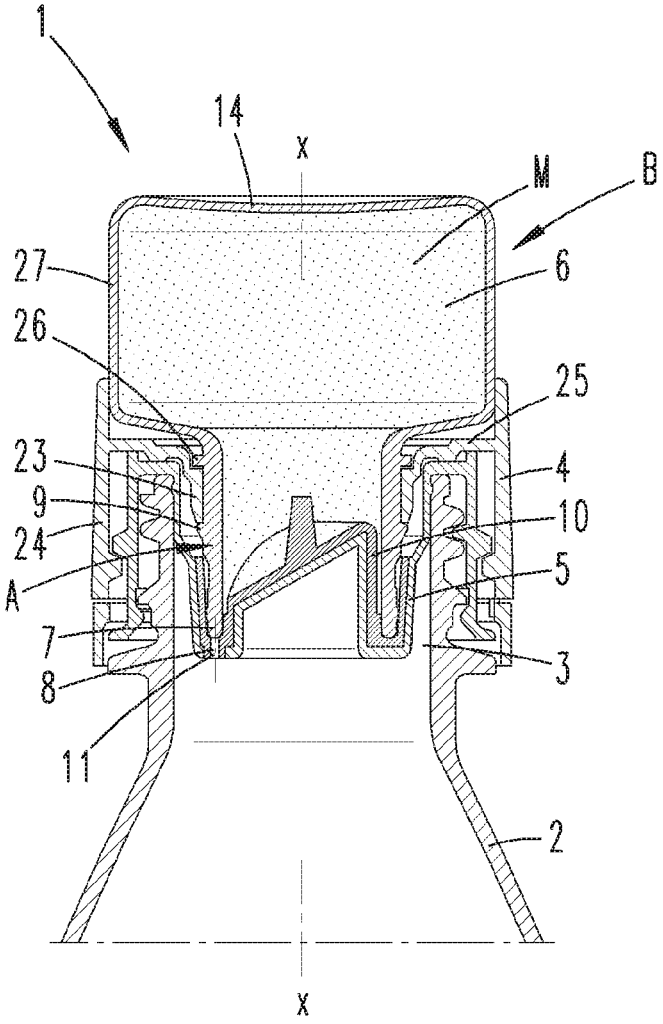
FIG. 10 shows a third embodiment in the form of a sectional representation according to FIG. 9.
Figure 11:
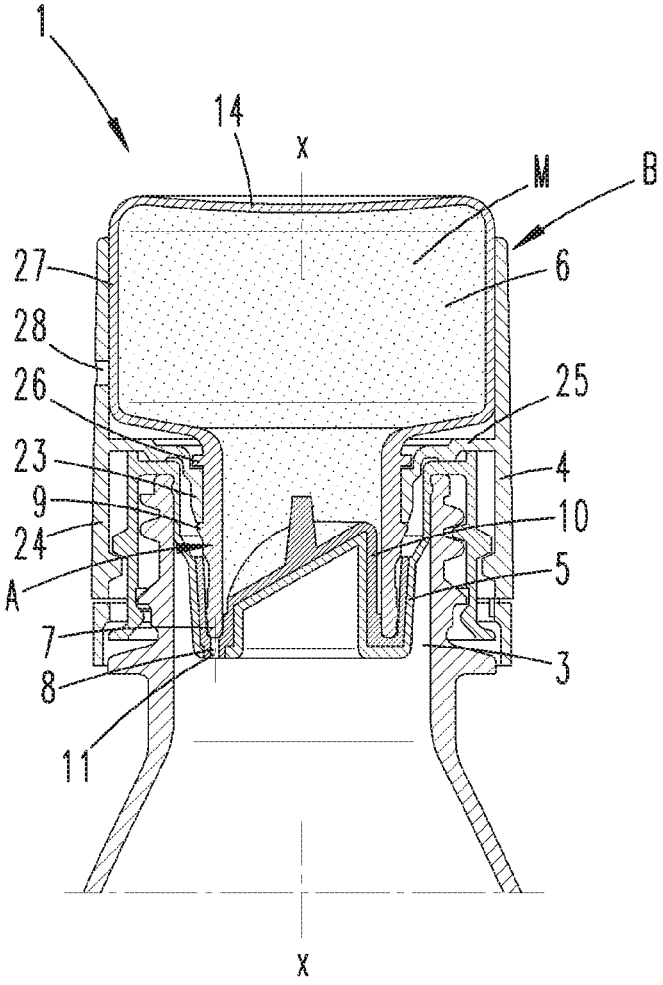
FIG. 11 shows a fourth embodiment in the form of a sectional representation according to FIG. 9.
Figure 12:
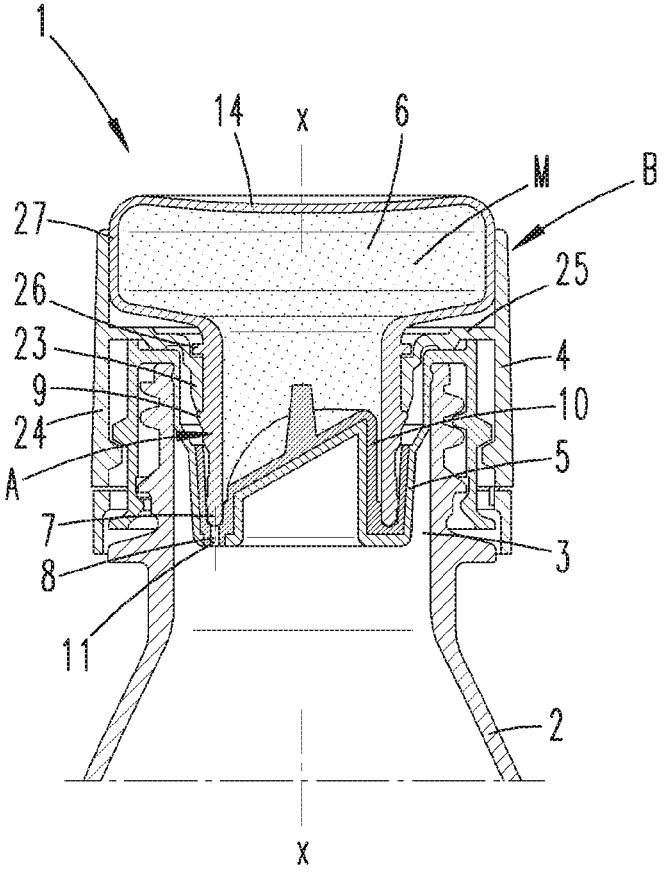
FIG. 12 shows a sectional representation according to FIG. 9 concerning a fifth embodiment.

According to the illustrations in FIGS. 10 to 12, a supporting shoulder 26 may furthermore be formed on the chamber wall such that it is axially spaced apart from the latching bead 9, wherein said supporting shoulder essentially rests on the supporting surface of the latching collar 23 in the latched and retained position of the chamber 6 on the cover element 4. The latching collar 23 may thereby be captured in the axial direction between the latching bead 9 and the supporting shoulder 26 in the latched and retained position.

The figures furthermore show that the ceiling 14 of the chamber 6 may be exposed in the latched and retained position and accordingly not overlapped by a cover element section in this case. The ceiling 14 and optionally also a partial section of the circumferential chamber wall 27, particularly of the region B with the larger diameter, is visible to the user, wherein the cover element wall 24 encompassing this chamber wall 27 extends for this purpose over a shorter length in the axial direction than the encompassed region B with the larger diameter.

In this case, the axial length of the chamber wall 27 in the region B of the chamber with the larger diameter may approximately correspond to between 0.15-times and 10-times the length of the cover element wall 24 in the same direction starting from the supporting shoulder 26.

This embodiment provides a view into the chamber interior, particularly in connection with a potential transparent or partially transparent design of the chamber wall 27.

Alternatively or additionally to the above-described design, a window-like opening 28 may also be provided in the cover element wall 24 for this purpose.

The preceding explanations serve for elucidating all inventions that are included in this application and respectively enhance the prior art independently with at least the following combinations of characteristics, namely:

A closure device, which is characterized in that the chamber 6, which is designed to be closed except for an opening 15 on the container side, is retained in the cover element 4 in a latching manner.

A closure device, which is characterized in that the chamber 6 has a region A with a smaller diameter and a region B with a larger diameter, wherein the region B with the larger diameter is spaced apart farther from the opening 15 and the region B with the larger diameter including a ceiling 14 is formed integrally with the region A with the smaller diameter.

A closure device, which is characterized in that a shoulder 16 is formed on the outer side of the chamber wall.

A closure device, which is characterized in that a circumferential latching bead 9 is formed on the outer side of the chamber wall 27 in order to interact with the cover element 4 in a latching manner.

A closure device, which is characterized in that the cover element 4 has a latching collar 23 for interacting with the shoulder 16 or the latching bead 9 on the side of the chamber wall.

A closure device, which is characterized in that the latching collar 23 is penetrated by the region A of the chamber 6 with the smaller diameter, wherein the clear cross-sectional area of the latching collar 23, through which the region A with the smaller diameter extends, has a smaller diameter than the region B of the chamber 6 with the larger diameter.

A closure device, which is characterized in that the chamber 6 is positively secured on the cover element 4 about a longitudinal axis x that penetrates the opening 15 on the container side in an emptying direction E of the chamber 6.

A closure device, which is characterized in that the chamber is positively secured by means of one or more flattenings 12, which are formed in an outer surface and extend in the longitudinal direction of the chamber 6 over one-fifth or more of the dimension of the region B with the larger diameter, wherein said flattenings interact with an identically shaped inner flattening 13 of the cover element 4.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristics of the dependent claims characterize independent inventive enhancements of the prior art, particularly for submitting divisional applications on the basis of these claims.

LIST OF REFERENCE SYMBOLS

| | |
|---|---|
| 1 | Closure device |
| 2 | Container |
| 3 | Container opening |
| 4 | Cover element |
| 5 | Inner housing |
| 6 | Chamber |
| 7 | Closure pin |
| 8 | Closure opening |
| 9 | Latching bead |
| 10 | Sealing element |
| 11 | Flow channel |
| 12 | Flattening |
| 13 | Inner flattening |
| 14 | Ceiling |
| 15 | Opening |
| 16 | Shoulder |
| 17 | Counterlatch |
| 18 | Latching part |
| 19 | Latching collar |
| 20 | Sealing lip |
| 21 | Channel dome |
| 22 | Thread |
| 23 | Latching collar |
| 24 | Cover element wall |
| 25 | Collar |
| 26 | Supporting shoulder |
| 27 | Chamber wall |
| 28 | Opening |
| A | Region |
| B | Region |
| E | Emptying direction |
| M | Medium |
| a | Extent |
| b | Extent |
| x | Longitudinal axis |

The invention claimed is:

1. A closure device (1) for closing a container opening (3) of a container (2), particularly a beverage bottle, wherein the closure device (1) has a cover element (4), a chamber (6) arranged on the cover element (4) and an inner housing (5), wherein the chamber (6) has a closing means and the inner housing (5) has an opening means, wherein the closing and opening means which correspond to one another and move relative to one another in such a way that a medium (M) contained in the chamber (6) can exit into the container (2) as a result of a movement of the cover element (4) relative to the inner housing (5), and wherein the chamber (6), which is designed to be completely closed except for an opening (15) on a container side, is retained in the cover element (4) in a latching manner, wherein a circumferential latching bead (9) is formed on an outer side of the chamber wall in order to interact with the cover element in the latching manner, wherein the closure device is configured to be screwed onto the container, and off of the container to completely expose the container opening, and wherein the opening means comprises a sealing element having two circumferential sealing zones, with a first one of the sealing zones being disposed on an outer circumferential surface of the opening means, interacting with an inner surface of the chamber, and the other one of the sealing zones being inwardly offset relative to the first sealing zone and interacting with the closing means of the chamber.

2. The closure device according to claim 1, wherein the chamber (6) has a region (A) with a smaller diameter and a region (B) with a larger diameter, wherein the region (B) with the larger diameter is spaced apart farther from the opening (15) than the region (A), and wherein the region (B) with the larger diameter including a ceiling (14) is formed integrally with the region (A) with the smaller diameter.

3. The closure device according to claim 2, wherein the cover element (4) has a latching collar (23) for interacting with the latching bead (9) on the side of the chamber wall.

4. The closure device according to claim 3, wherein the latching collar (23) is penetrated by the region (A) of the chamber (6) with the smaller diameter, wherein a clear cross-sectional area of the latching collar (23), through which the region (A) with the smaller diameter extends, has a smaller diameter than the region (B) of the chamber (6) with the larger diameter.

5. The closure device according to claim 1, wherein the chamber (6) is positively secured on the cover element (4) about a longitudinal axis (x) that penetrates the opening (15) on the container side in an emptying direction (E) of the chamber (6).

6. The closure device according to claim 2, wherein the region (B) with the larger diameter has a maximum extent (b) transverse to a longitudinal axis (x), which approximately corresponds to between 1.5-times and 2-times, a maximum extent (a) of the region (A) with the smaller diameter in the same direction.

7. The closure device according to claim 6, wherein a length of the regions (A) and (B) in the axial direction is approximately chosen identical, wherein an axial length of a partial region approximately corresponds to the extent (b).

8. The closure device according to claim 6, wherein the maximum extent of the region (B) with the larger diameter corresponds to between 1.6 and 1.8 times the maximum extent (a) of the region (A) with the smaller diameter in the same direction.

* * * * *